US006976948B1

(12) United States Patent
Hamblad

(10) Patent No.: US 6,976,948 B1
(45) Date of Patent: Dec. 20, 2005

(54) METHOD FOR ADJUSTING A RADIAL LEVEL OF AN INTERFACE IN A CENTRIFUGAL SEPARATOR

(75) Inventor: Ervin Hamblad, Huddinge (SE)

(73) Assignee: Alfa Laval AB, Tumba (SE)

( * ) Notice: Subject to any disclaimer, the term of this patent is extended or adjusted under 35 U.S.C. 154(b) by 221 days.

(21) Appl. No.: 09/936,105

(22) PCT Filed: Jun. 2, 2000

(86) PCT No.: PCT/SE00/01154

§ 371 (c)(1),
(2), (4) Date: Jun. 19, 2003

(87) PCT Pub. No.: WO00/74858

PCT Pub. Date: Dec. 14, 2000

(30) Foreign Application Priority Data

Jun. 3, 1999 (SE) ..... 9902090

(51) Int. Cl.[7] ..... B04B 1/08; B04B 11/08
(52) U.S. Cl. ..... 494/37; 494/10; 494/57; 494/70
(58) Field of Search ..... 494/1–4, 10, 37, 494/56–57, 68–70

(56) References Cited

U.S. PATENT DOCUMENTS 4,525,155 A * 6/1985 Nilsson
4,622,029 A * 11/1986 Nilsson
4,755,165 A * 7/1988 Gunnewig
5,405,307 A * 4/1995 Borgstrom et al.
5,788,622 A * 8/1998 Borgstrom et al.
6,616,589 B1 * 9/2003 Maehans

FOREIGN PATENT DOCUMENTS

WO WO 94/06565 3/1994
WO WO 97/27946 8/1997
WO 03/024606 A1 * 3/2005

* cited by examiner

*Primary Examiner*—Charles E. Cooley
(74) *Attorney, Agent, or Firm*—Michaud-Duffy Group LLP

(57) ABSTRACT

A method for adjusting an interface formed during operation between a specific light liquid phase and a specific heavier liquid phase to a wanted radial level in a centrifugal separator, in which the separation chamber is emptied of its contents and the inlet opening is brought to a radial inner position in the outlet chamber, after which a pre-determined volume of the specific heavier liquid phase is supplied to the separation chamber and the mixture of the two liquid phases is supplied to the separation chamber via the supply conduit and the inlet chamber whereby the separation chamber is filled up and an interface between the two liquid phases is formed, which is displaced radial outwardly, the displaced specific heavier liquid phase then being pressed radial inwardly in the outlet channel and further into the outlet chamber. A first pressure sensor indicates when the separation chamber has been filled up to a wanted level, after which the position of the inlet opening is moved towards the free liquid surface in the outlet chamber until the inlet opening reaches the liquid surface and the specific heavier liquid phase in the outlet chamber is discharged through the inlet opening and the discharge channel, which is indicated by a second pressure sensor. The inlet opening is prevented from moving at least radially outwardly from its obtain position, which substantially corresponds to a wanted position of the interface. During the following normal operation the liquid phases are separated and discharged through an outlet device each during maintaining the radial level of the free liquid surface in the outlet chamber and consequently also the radial level of the interface.

7 Claims, 2 Drawing Sheets

METHOD FOR ADJUSTING A RADIAL LEVEL OF AN INTERFACE IN A CENTRIFUGAL SEPARATOR

FIELD OF THE INVENTION

The present invention concerns a method for adjusting an interface formed during operation between a specific light liquid phase and a specific heavier liquid phase to a wanted radial level in a centrifugal separator.

BACKGROUND OF THE INVENTION

A centrifugal separator of this kind comprises a rotor, which is rotatable around a rotation axis in a certain rotational direction, which rotor forms inside itself

- an inlet chamber, in which a conduit for the supply of a mixture of the two liquid phases, which are to be separated, opens
- a separation chamber communicating with the inlet chamber,
- an outlet device for the discharge of the specific light liquid phase separated during operation the outlet device including an outlet passage, which is connected to a radial inner portion of the separation chamber, and
- another outlet device for the discharge of the specific heavier liquid phase separated during operation this outlet device comprising an outlet channel formed in the rotor, which extends radially and has an inlet opening at its radial outer end located at a certain radial level in a radial outer portion of the separation chamber and at its radial inner end opens in an outlet chamber surrounding the rotation axis, in which the specific heavier liquid phase forms a rotating liquid body having a radially inwardly turned free liquid surface. The radial position of the free liquid surface, during operation takes a position at a level in balance with the pressure prevailing in the separation chamber at the inlet opening, and in which a discharge device is arranged. The discharge devices non-rotatable with the rotor and has at least one internal discharge channel, which extends radially and at it radial outer end has an inlet opening. At a radial inner end the discharge channel is connected to an outlet, at least a radial outer part of the discharge device, in which the inlet opening is located, being movable in a way such that the inlet opening can be put in a different radial position in the outlet chamber.

The centrifugal separator further comprises means for the supply of a predetermined volume of the specific heavier liquid phase to the separation chamber, a first indicating means for indicating that the separation chamber during operation is filled up to a certain wanted level, means for keeping the separation chamber filled up to this radial level, and a second indicating means for indicating the radial position of the free liquid surface in the outlet chamber for the specific heavier liquid phase, In order to achieve a good separation result in a centrifugal separator it is of great importance at which radial level the interface between a light and heavier liquid phase is formed during an operation in the separation chamber of the centrifugal rotor. The interface will take a position at such a radial level that equilibrium will occur between the two liquid columns of the two liquid phases.

In order to maintain the interface at a wanted level in centrifugal separators, in which both the specific light and the specific heavier liquid phase forms a free liquid surface at one outlet out of the separation chamber each. The outlet for the specific light phase out of the separation chamber has been provided with an overflow outlet in the shape of a level ring surrounding the rotation axis and the outlet for the heavier liquid phase and as well with an overflow outlet in the shape of a control ring surrounding the rotational axis.

Generally if an unsatisfactory separation result is obtained one wishes to adjust the radial position of the interface to stop the centrifugal separator in order to exchange the control ring to a different control ring having another radius for the overflow outlet. Often, it is not enough to stop the centrifugal separator once to change the control ring but this has to be done several times before a control ring having a radius for the overflow outlet which gives a satisfactory separation result is found. This constitutes a difficult and time consuming operation and if for instance the density of one of the liquid phases in the mixture varies this can cause repeated down times.

To be able to adjust the radial position of the interface without the need for the centrifugal separator to be stopped for the exchange of such a control ring it has been suggested that instead of controlling the radial position of the interface by means of the radius of the overflow outlet, one provide the outlet device for the discharge of the specific heavier liquid phase with an outlet chamber, which during operation is pressure connected to the separation chamber via an outlet channel, whereby an obtained free liquid surface in the outlet chamber will be determining for the radial level of the interface. According to this suggestion a stationary discharge device is arranged in the outlet chamber, which has an internal discharge channel, which extends radially and in its radial outer end has an inlet opening and in its radial inner end is connected to an outlet, the inlet opening during operation being located radially outside the free liquid surface. The radial position of the free liquid surface is adjusted by means of a valve arranged in the outlet, which gives a variable counter pressure in the outlet, which so influences the free liquid surface in the discharge chamber that the higher the counter pressure is the bigger the radial distance between the free liquid surface and the inlet opening is. Thus, the counter pressure set in the outlet controls the radial position of the interface.

Naturally, the radial position of the interface can be controlled in a corresponding manner by adjusting the counter pressure in the outlet for the specific light liquid phase.

Whether the radial position of the interface is regulated by the exchange of the control ring or by adjusting the counter pressure in the outlet of the one or the other liquid phase you have no acceptable control of the radial level at which the interface is located. This means that a small change of the condition of the operation might have a great influence on the separation result. The control by means of adjusting the counter pressure according to the method described above furthermore results in an unacceptable generation of heat in the discharge of the chamber as a result of the stationary discharge device partly being immersed in the rotating liquid body in the outlet chamber.

The object of the present invention is to provide a simple method for adjusting the above-described interface to a wanted radial level without the need for the centrifugal separator to be stopped and disassembled.

SUMMARY OF THE INVENTION

According to the present invention this is accomplished by emptying the separation chamber in a centrifugal separator of the kind in question for the invention of its contents and bringing the inlet opening to a radial inner position in the outlet chamber. Thereafter such a large pre-determined volume of the specific heavier liquid phase is supplied to the separation chamber that this volume, during rotation of the rotor, fills up radially inwardly to a radial level located radially inside the inlet opening of the outlet channel such that the volume portion of the supplied heavier liquid phase, which is located radially inside the inlet opening, is larger than the total volume of the outlet channel and a portion of the volume of the outlet chamber. When this volume of the specific heavier liquid phase has been supplied to the separation chamber, a mixture of the two liquid phases is supplied to the separation chamber via the supply conduit and the inlet chamber whereby the separation chamber gradually is filled up radially inwardly and an interface between the two liquid phases is formed, which is displaced radially outwardly. The displaced specific heavier liquid phase then being pressed radial inwardly in the outlet channel and further into the outlet chamber where it forms a rotating liquid body having a radially inwardly free liquid surface. This is displaced radialy inwardly while the separation chamber is filled up, which takes place until the separation chamber has been filled up to a desired level, this level is indicated by the first indicating means, after which the position of the radial outer part of the discharge device is changed so that the inlet opening is moved towards the free liquid surface in the outlet chamber until the inlet opening reaches the liquid surface and the specific heavier liquid phase in the outlet chamber is discharged through the inlet opening and the discharge channel. This is indicated by the second indicating means. After this the inlet opening is prevented from moving at least radially outwardly from its obtained position, which substantially corresponds to a wanted position of the interface. However, the inlet opening is pressed radially outwardly towards the obtained position by means of a force transferring element acting on the outer moveable portion of the discharge device, after which a normal operation is started. During normal operation which separation takes place and the separated specific light liquid phase and the separated specific heavier liquid phase are discharged through an outlet device while maintaining the radial level of the free liquid surface in the outlet chamber and consequently also the radial level of the interface.

In a preferred embodiment of the invention the centrifugal separator comprises a stack of conical separation discs arranged in the separation chamber, each having a radial outer edge located at a radial distance from the inlet opening. Such a large pre-determined volume of the specific heavier liquid phase is supplied to the separation chamber that this volume during rotation of the rotor fills up radially inwardly to a radial level, which is located so much radially inside the inlet opening of the outlet channel so that the volume portion of the supplied specific heavier liquid phase, which is located radially inside the inlet opening, is larger than the total volume of the outlet channel and a portion of the volume of the outlet chamber and the radial outermost third of the volume of the separation chamber, which is delimited radially inwardly by the radius of the outer edges of the separation discs and radially outwardly by the radius of the inlet opening but less than the total volume of the volume of the outlet channel and a portion of the volume of the outlet chamber and the portion of the volume of the separation chamber, which is delimited radially inwardly by the radius of the outer edges of the separation discs and radially outwardly by the radius of the inlet opening.

In another embodiment of the invention the movable outer portion of the discharge device is arranged turnable around a turning axis, which is approximately parallel to and eccentric relative to the rotational axis, the position of the radial outer part of the discharge device is changed and the inlet opening is displaced towards the free liquid surface by turning the radial outer part around the turning axis. Preferably, the radial outer part is turned around the turning axis in a rotational direction, which is opposite to the rotational direction of the rotor.

In another embodiment of the invention the radial outer part has a projection, the inlet opening being prevented from moving radially outwardly from the radial position it has obtained when the second indicating means has indicated that the specific heavier liquid phase is discharged through the inlet opening and the outlet channel by putting an adjustable stop against the projection. It is preferred that the radial outer part is turned in such a way that the inlet opening is displaced radially outwardly by a force transferring element in the form of a resilient element.

According to a further embodiment the radial outer part is influenced during operation by a moment from the specific heavier liquid phase present in the outlet chamber, which strives to turn this outer part in a way such that the inlet opening is displaced radially inwardly, which moment increases by moving the portion of the outer part being in contact with the specific heavier liquid phase into the outlet chamber and displacing the inlet opening radially inwardly when this moment exceeds the moment from the force transferring element.

BRIEF DESCRIPTION OF THE DRAWINGS

In the following the invention will be described more closely with reference to the attached drawings, in which.

DETAILED DESCRIPTION OF THE PREFERRED EMBODIMENT

Figure 1:
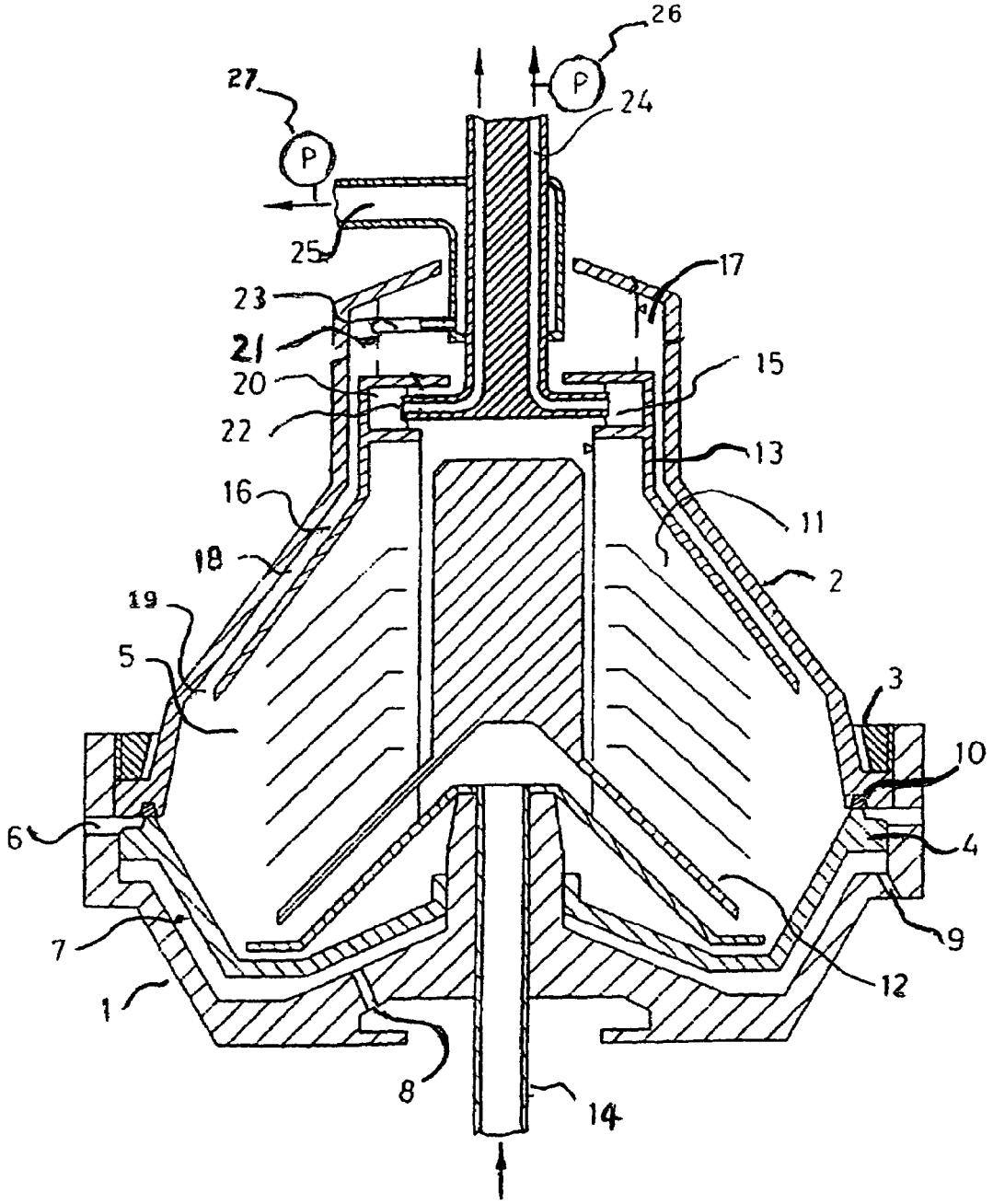
FIG. 1 schematically shows an axial section through a part of a centrifugal separator of the kind useful for the invention.

In FIG. 1 there is shown a part of a centrifugal separator comprising a rotor rotatable around a rotational axial in a certain rotational direction, which has a lower part 1 and an upper part 2, which are joined together axially by a locking ring 3. Inside the rotor an axially movable valve slide 4 is arranged. This valve slide 4 delimits together with the upper part 2 a separation chamber 5 and is arranged to open and close an outlet passage between the separation chamber 5 and an outlet opening 6 for the discharge intermittently of a phase which has been separated out of a mixture supplied to the rotor and has been accumulated at the periphery of the separation chamber 5. The valve slide 4 delimits together with the lower part 1 a closing chamber 7, which is provided with an inlet 8 and a throttled outlet 9 for a closing liquid. During the rotation of the rotor, the valve slide 4 is acted upon by the pressure from the closing liquid present in the closing chamber 7 by the influence of the centrifugal force into sealing abutment against an annular seal 10 arranged in the upper part 2.

Inside the separation chamber 5 a stack 11 of a number of conical separation discs is arranged between a distributor 12 and an upper disc 13. In the example shown in FIG. 1 the rotor is mounted on a hollow shaft 14, through which the mixture of the specific light and the specific heavy liquid phase, which is to be centrifugally treated, is supplied to the rotor. As shown in FIG. 1 the upper disc 13 forms at upper end a centrally located first outlet chamber 15 for a specific light liquid phase separated in the separation chamber 5. This first outlet chamber 15 communicates with the separation chamber 5 via a first overflow outlet 16, over which the specific lighter liquid component can flow out of the separation chamber 5.

The upper part 2 of the rotor forms a centrally located second outlet chamber 17, into which a specific heavier liquid phase can flow out of a radial outer portion of the separation chamber 5 via an outlet channel 18 having an inlet opening 19 in a radial outer portion of the separation chamber 5. During operation, the specific heavier liquid phase flows out of the separation chamber to the outlet chamber 17.

In each outlet chamber there is arranged a stationary discharge device 20 and 21. These discharge devices are provided with peripheral inlet openings 22 and 23, which are connected to a central outlet 24 and 25 respectively. The discharge devices 20 and 21 extend essentially perpendicular to the rotational axis that during operation they are partly located in a rotating liquid body of the specific light, and heavier liquid phase present in the outlet chambers 15, and 17. In the outlet 24 for the specific light liquid phase there is arranged a first indicating means 26 in the form of a pressure sensor and in the outlet 25 for the specific heavier liquid phase there is arranged a second indicating means 27.

Figure 2:
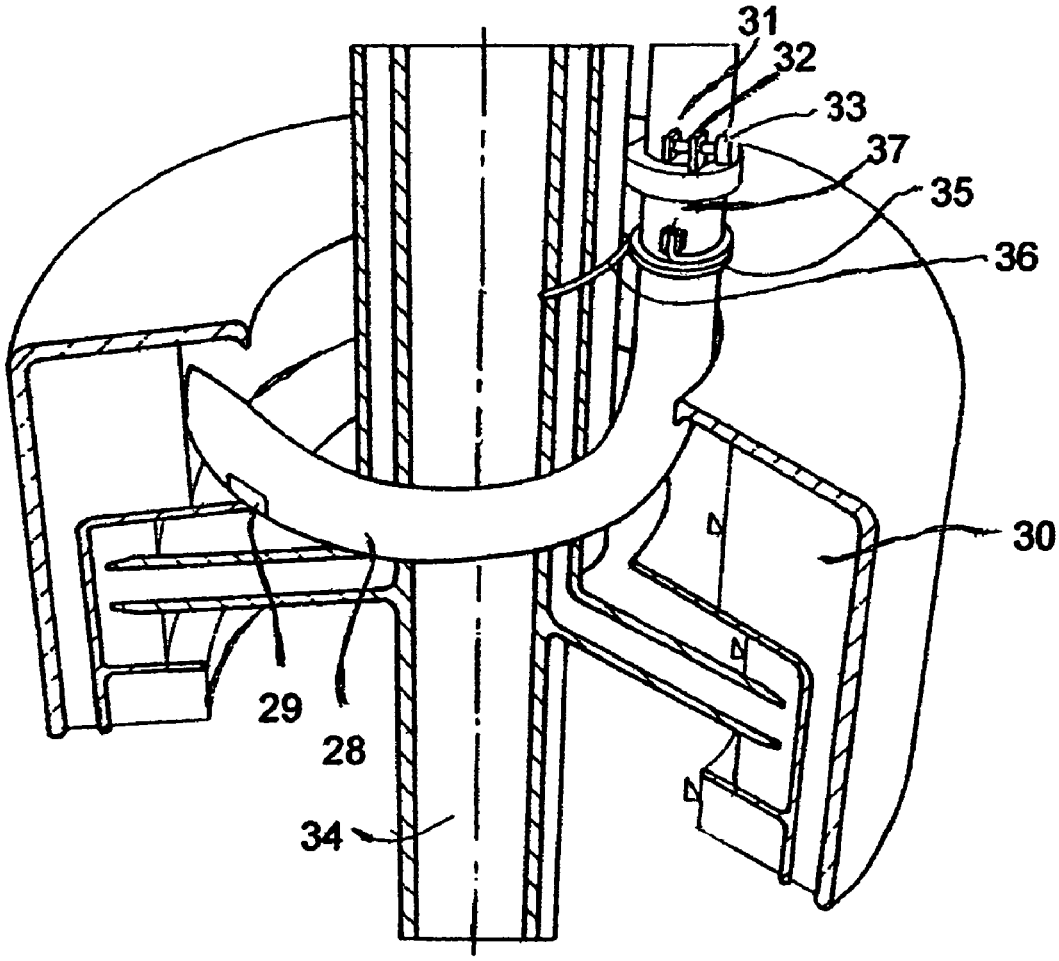
FIG. 2 shows a partly in section view of a smaller part of a centrifugal separator of FIG. 1.

In FIG. 2 there is shown more closely how a discharge device for the discharge of the specific heavier liquid phase in a centrifugal separator of the kind in question for the present invention is configured.

The discharge device 28 is, as a whole, turnably arranged around a turning axis which is parallel to an eccentric with respect to the rotational axis so that the inlet opening 29 can be displaced in a direction towards the free liquid surface discharge chamber 30 when the discharge device 28 is turned in a direction (counter clockwise) opposite to the rotation direction of the rotor (clockwise). On the discharge device a projection 31 is arranged and a stop 32 is connected to non-rotatable parts of the centrifugal separator, which is adjustable by means of an adjustable member in the shape of screw 33. As shown in FIG. 2 the supply conduit 34 also can be arranged centrally through the discharge device for the specific light liquid phase. The discharge device is so turned that the inlet opening is displaced radially outwardly by means of a moment from a force transmitting element in the shape of a spring 35, which in one of its ends 36 is fixedly connected to a non rotatable part of centrifugal separator and in its other end its fixed to a the discharge device 28.

The centrifugal separator according to the invention shown in FIG. 1 functions in the following manner:

In connection with the start of the centrifugal separator the rotor begins to rotate, the separation chamber 5 is closed by supplying a closing liquid to the closing chamber through the inlet 8. As soon as the separation chamber 5 is closed the liquid mixture to be centrifugally treated can be supplied to the separation chamber 5 through the hollow shaft 14. When the rotor has obtained the operational rate of rotation and the separation chamber 5 has been filled up, the liquid phases in the liquid mixture are separated by the influence of the centrifugal force acting on the same. The separation then takes place mainly in the interspaces between the conical discs in the stack 11. During the separation the specific heavier liquid phase is thrown radially outwardly towards a periphery of the separation chamber 5 where it accumulates, whereas the specific light liquid phase flows radially inwardly in these interspaces.

If the centrifugal treated liquid mixture also comprises heavy particles these are accumulated at the outermost periphery of the separation chamber 5.

The specific light liquid phase flows over to the first outlet chamber 15 via the first overflow outlet 16, which thereby becomes determining for the radial level of the free liquid surface in the separation chamber 5. Via the first discharge device 20, which in this case consists of a conventional paring disc, the light liquid phase is under pressure out of the centrifugal rotor through the first outlet 24.

The specific heavier liquid phase, which has been accumulated at the periphery of the separation chamber 5, flows radially inwardly through the outlet channel 18 via inlet opening 19 and into the outlet chamber 17. Herein it forms a cylindrical liquid body rotating with the rotor. During operation this discharge device extends radially into the outlet chamber 17 that a portion thereof is located in the rotating liquid body. However, so much of the discharge device is located in the rotating liquid body that at least a portion of the inlet opening 23 or 29 is located in the rotating liquid. The friction between the outside of this discharge device 21 and the rotating liquid body hereby will become low. Through the discharge device 21 the specific heavier liquid phase is discharged under pressure out of the centrifugal separator through a second outlet 25.

According to the present invention an interface (shown in dashed lines in FIG. 1) formed during operation between a specific light liquid phase and a specific heavier liquid phase is adjusted to a wanted radial level in the centrifugal rotor by emptying the separation chamber 5 of its contents and bringing the inlet opening in a radial inner position in the outlet chamber 17, 30. The separation chamber 5 is then supplied with such a pre-determined volume of the specific heavier liquid phase that this volume during the rotation of the rotor fills up radially inwardly to a radial level, which is located radially inside the inlet opening 19 of the outlet channel 18 that the volume portion of the supplied specific heavier liquid phase, which is located radially inside the inlet opening 19, at least is larger than the total volume of the outlet channel 18 and a portion of the outlet chamber 17. Thereafter the mixture of the two liquid phases is supplied to the separation chamber via the supply conduit 14, 34 and the inlet chamber. The separation chamber 5 is gradually filled up radially inwardly and an interface between the two liquid phases is formed, which is displaced radially outwardly, whereby the displaced specific heavier liquid phase is pressed radially inwardly in the outlet channel 18 and further into the outlet chamber 17, 30 where it forms a rotating liquid body with a radially inwardly turned free liquid surface. The free liquid surface is displaced radially inwardly while the separation chamber is filled up, which takes place until the separation chamber has been filled up to a wanted level, which is indicated by means of the first indicating means 26. After this the position of the outer portion 28 of the discharge device is changed so that the inlet opening 23, 29 is moved towards the free liquid surface in the outlet chamber 17, 30 until the inlet opening 23, 29 reaches the liquid surface and the specific heavier liquid phase in the outlet chamber 17, 30 is discharged through the inlet opening 23, 29 and the discharge channel, which is indicated by means of the second indicating means 27. Subsequently, the inlet opening 23, 29 is prevented from moving at least radially outwardly from its obtained position, which essentially corresponds to a wanted position of the interface (marked with a dashed line) while the inlet opening 23, 29 is pressed radially outwardly towards the obtained position by means of pressure transmitting element 35 acting on the outer movable portion of the discharge device where after normal operation is started and separation takes place and the separation separates the specific light liquid phase and the separated specific heavier liquid phase is discharged through an outlet device each during maintaining the radial level of the free liquid surface in the discharge chamber and thus also the radial level of the interface.

In the illustrated example the two indicating means consist of pressure sensors however, the present invention is not limited in this regard as other means can be employed to indicate that there is a liquid flow coming out of the respective outlet. The most simple method is for the operator to observe when liquid flows out of an outlet.

Of course, the predetermined volume of liquid supplied to the separation chamber need not be identical with the separated specific heavy phase but its density shall be higher than the the specific light phase and ought to be nearby the one of the specific heavier phase.

What is claimed is:

1. A method for adjusting an interface formed between a specific light liquid phase and a specific heavier liquid phase to a wanted radial level in a centrifugal separator, which includes:

a rotor having a rotation axis about which the rotor spins, an inlet chamber, in which a conduit for the supply of a mixture of the specific light phase and the specific heavier liquid phase, which is to be separated, opens, a separation chamber communicating with the inlet chamber, an outlet device for discharging the specific light liquid phase separated during operation comprising, the outlet devise an outlet passage connected to a radial inner portion of the separation chamber, and an outlet device for discharging the specific heavier liquid phase separated during operation, this outlet device comprising an outlet channel formed in the rotor extending radially and having an inlet opening at its radial outer end located at a certain radial level in a radial outer portion of the separation chamber, the outlet device at its radial inner end opening into an outlet chamber surrounding the rotation axis, in which the specific heavier liquid phase forms a rotating liquid body having a radially inwardly turned free liquid surface, the radial position of which during operation takes a position at a level in balance with the pressure prevailing in the separation chamber at the inlet opening, and in which a discharge device is arranged, which is non-rotatable with the rotor and has at least one internal discharge channel, which extends radially and at its radial outer end has an inlet opening and at its radial inner end is connected to an outlet, at least a radial outer part of the discharge device, in which the inlet opening is located, being movable in a way such that the inlet opening can be positioned in a different radial location in the outlet chamber, the centrifugal separator further comprising means for the supply of a predetermined volume of the specific heavier liquid phase to the separation chamber, a first indicating means for indicating that the separation chamber during operation is filled up to a certain wanted level, means for keeping the separation chamber filled up to this radial level, and a second indicating means for indicating the radial position of the free liquid surface in the outlet chamber for the specific heavier liquid phase, the method including the steps of emptying the contents of the separation chamber;

positioning the inlet opening to a radial inner position in the outlet chamber;

supplying a predetermined volume of the specific heavier liquid phase to the separation chamber so that during rotation of the centrifuge the rotor fills radially inwardly to a radial level located inside of the inlet opening of the outlet channel, this radial level being such that the portion of the volume radially inside of the inlet opening in larger than the combined volume of the outlet channel and a portion of the volume of the outlet chamber;

supplying a mixture of the specific lighter liquid phase on the specific heavier liquid phase to the separator chamber via the supply conduit and the inlet chamber;

forming an interface in the separation chamber between the specific lighter liquid phase and the specific heavier liquid phase;

causing the specific heavier liquid phase to be pressed radially inwardly in the outlet channel and further into the outlet chamber, thereby forming a rotating liquid body having a radially inwardly free liquid surface displaced inwardly until the separation chamber has been filled;

sensing the radial position of the free liquid surface via the first indication means;

adjusting the position of the radial outer part of the discharge device so that the inlet opening is moved toward the free liquid surface is the outlet chamber, this movement continuing until the inlet opening reaches the liquid surface and the specific heavier liquid phase in the outlet chamber is discharged through the inlet opening and the discharge channel;

sensing that the heavier liquid phase is being discharged through the inlet opening via the second indicating means;

preventing the inlet opening from moving by means of a force transferring element acting on the outer moveable portion of the discharge device; and allowing the centrifuge to operate so that separation takes place and the heavier liquid phase and the specific lighter liquid phase are each discharged, through one of the outlet devices while maintaining the desired radial level for the free liquid surface in the outlet chamber.

2. A method according to claim 1, in which the centrifugal separator comprises a stack of conical separation discs arranged in the separation chamber, each one of which having a radial outer edge located at a radial distance from the inlet opening, said method further including supplying such a large pre-determined volume of the specific heavier liquid phase to the separation chamber that this volume during rotation of the rotor fills up radially inwardly to a radial level, which is located so much radially inside the inlet opening of the outlet channel that the volume portion of the supplied specific heavier liquid phase, which is located radially inside the inlet opening, at least is larger than the total volume of the outlet channel and a portion of the volume of the outlet chamber and the radial outermost third of the volume of the separation chamber, which is delimited radially inwardly by the radius of the outer edges of the separation discs and radially outwardly by the radius of the inlet opening but less than the total volume of the volume of the outlet channel and a portion of the volume of the outlet chamber and the portion of the volume of the separation chamber, which is delimited radially inwardly by the radius of the outer edges of the separation discs and radially outwardly by the radius of the inlet opening.

3. A method according to claim 1, wherein in which the movable outer portion of the discharge device is turnable around a turning axis, which is approximately parallel to and eccentric relative to the rotational axis, that the position of the radial outer part of the discharge device is changed and the inlet opening is displaced towards the free liquid surface by turning the radial outer part around the turning axis.

4. A method according to claim 3, wherein the radial outer part is turned around the turning axis in a rotational direction which is opposite to the rotational direction of the rotor.

5. A method according to claim 3, wherein the radial outer part has a projection, the inlet opening being prevented from moving radially outwardly from the radial position it has obtained when the second indicating means has indicated that the specific heavier liquid phase is discharged through the inlet opening and the outlet channel by putting an adjustable stop against the projection.

6. A method according to claim 3, wherein the radial outer part is turned in such a way that the inlet opening is displaced radially outwardly by means of a moment from the force transferring element in the form of a resilient element.

7. A method according to claim 6, wherein the radial outer part is influenced during operation by a moment from the specific heavier liquid phase present in the outlet chamber, which strives to turn this outer part in a way such that the inlet opening is displaced radially inwardly, which moment increases by a increasing portion of the outer part being in contact with the specific heavier liquid phase into the outlet chamber and displaces the inlet opening radially inwardly when this moment exceeds the moment from the force transferring element.

* * * * *